US005859615A

United States Patent [19]

Toland et al.

[11] Patent Number: 5,859,615

[45] Date of Patent: Jan. 12, 1999

[54] OMNIDIRECTIONAL ISOTROPIC ANTENNA

[75] Inventors: Brent T. Toland, Manhattan Beach; Rork S. Brown, Los Angeles; Robert L. Hart, Culver City, all of Calif.

[73] Assignee: TRW Inc., Redondo Beach, Calif.

[21] Appl. No.: 814,367

[22] Filed: Mar. 11, 1997

[51] Int. Cl.[6] ..... H01Q 19/06

[52] U.S. Cl. ..... 343/753; 343/754; 343/785; 343/909

[58] Field of Search ..... 343/753, 754, 343/756, 785, 909, 772, 775; H01Q 19/06, 13/00, 19/14

[56] References Cited

U.S. PATENT DOCUMENTS

| | | | |
|---|---|---|---|
| 4,070,678 | 1/1978 | Smedes | 343/754 |
| 5,121,129 | 6/1992 | Lee et al. | 343/753 |
| 5,283,590 | 2/1994 | Wong | 343/754 |
| 5,450,093 | 9/1995 | Kim | 343/895 |

*Primary Examiner*—Don Wong
*Assistant Examiner*—Hoang Nguyen
*Attorney, Agent, or Firm*—Michael S. Yatsko

[57] ABSTRACT

An omnidirectional isotropic antenna employing a tubular waveguide 12, a dielectric insert 18 which includes a lens 20 and a depending stem 22. The lens 20 is an elliptoid generated by rotating an elliptoid form about the longitudinal axis 42 of the tubular waveguide 12 with its foci 40 aligned with the longitudinal axis 42 and its major axis 38 lying in a zone of rotation 43 intersecting the horizontal plane 44 that is normal to the axis 42 and containing the foci 40. The stem 22 has integrally formed a polarizing element 36, and an impedance to matching element 21. There is provided a passband filter 50 and a modified tubular waveguide 60 that provides node differences for the RF signals.

16 Claims, 9 Drawing Sheets

OMNIDIRECTIONAL ISOTROPIC ANTENNA

BACKGROUND

1. Field of Invention

This invention relates generally to omnidirectional isotropic antennas, and more particularly, to omnidirectional antennas that transceive isotropic radiation patterns using a dielectric lens structure.

2. Discussion

Omnidirectional isotropic antennas are extremely important in transmitting and receiving electromagnetic radiation patterns where the direction is variable and it is undesirable to use pointing or detecting mechanisms. Known omnidirectional isotropic antennas are capable of producing uniform patterns in azimuth but not routinely in elevation. That is, the pattern is azimuthally symmetric but is not isotropic. Antennas that produce isotropic radiation patterns can be used with transponders, walky-talkies, automobile radios and cellular telephones. For these applications the antenna must be relatively small to be portable. In addition, at millimeter wave frequencies these antennas can be difficult and expensive to manufacture.

Certain known antenna structures capable of producing isotropic radiation are physically quite large. For example, there is disclosed in U.S. Pat. No. 5,283,590, granted to Gary G. Wong, a procedure for modifying the RF pattern electronically which results in a rather large antenna structure. Antennas that are required to transceive millimeter electromagnetic waves in the range of 38 Ghz to 95 Ghz and higher, are of necessity quite small in size. Other prior patents teaching omnidirectional performance such as U.S. Pat. No. 5,450,093, granted to Chang S. Kim, employ a waveguide encircled with helical dielectric strands. Such an antenna may be useful for radiation in the microwave frequency range, but at millimeter wave frequencies, a very small structure would be required which would be difficult to fabricate. The helical antennas also require a phasing circuit which electronically provides the necessary circular polarization. The instant invention provides in combination with its dielectric lens insert polarization structures, passband filters, and an impedance matching element that are integral with the dielectric lens.

SUMMARY OF THE INVENTION

The antenna of this invention provides an omnidirectional (azimuthally symmetric) radiation pattern at microwave and millimeter wave frequencies (1 to 400 Ghz). The radiation pattern in the non azimuthal (or elevation) plane is determined by the shape and size of the dielectric material; a wide range of omnidirectional radiation patterns can be produced including isotropic radiation patterns over a hemisphere. This invention is therefore suitable for any applications that require an omni-directional or isotropic radiation pattern. There is provided a tubular waveguide comprising a base portion and a top opening which forms the horn aperture. The shape of the lens controls the polar radiation pattern that is transmitted or received by the antenna. The shaped elliptoid lens portion is produced by rotating an ellipse form having a major and minor axis and foci about the longitudinal axis of the waveguide with one of the foci coincident with the horn aperture and the major axis lying in a predetermined zone of rotation and the angle between the major axis and the plane containing the foci, which is normal to the longitudinal axis of the waveguide. Impedance matching is provided by tapering the dielectric insert to transition form unfilled to filled waveguide impedance.

A polarizing element is formed integral with the dielectric insert, located between the tapered stem portion and the underside of the dielectric lens. The polarizing element is formed by reducing a longitudinal section of the stem thereby changing the path length of the RF signal through the depending stem by increasing the air space through which a component of the signal travels.

A passband filter is integrally formed as part of the stem comprised of a series of circumferential grooves which are formed normal to the longitudinal axis of the stem waveguide and in spaced apart relationship to act as a filter.

The invention also provides for a modified waveguide to control the RF signal patterns by using alternate waveguide modes. The modification includes a waveguide extension affixed to and spaced apart from the primary waveguide through a flanged connector and includes a coaxial cable axially received within the waveguide extension reaching into the primary waveguide and thereby directing RF signals to the dielectric insert. The difference mode causes the RF signal to form a flared out pattern.

BRIEF DESCRIPTION OF THE DRAWINGS

These and other features, aspects, and advantages of the present invention will become better understood from the following description, appended claims, and accompanying drawings:

DETAILED DESCRIPTION OF THE PREFERRED EMBODIMENTS

Figure 1:
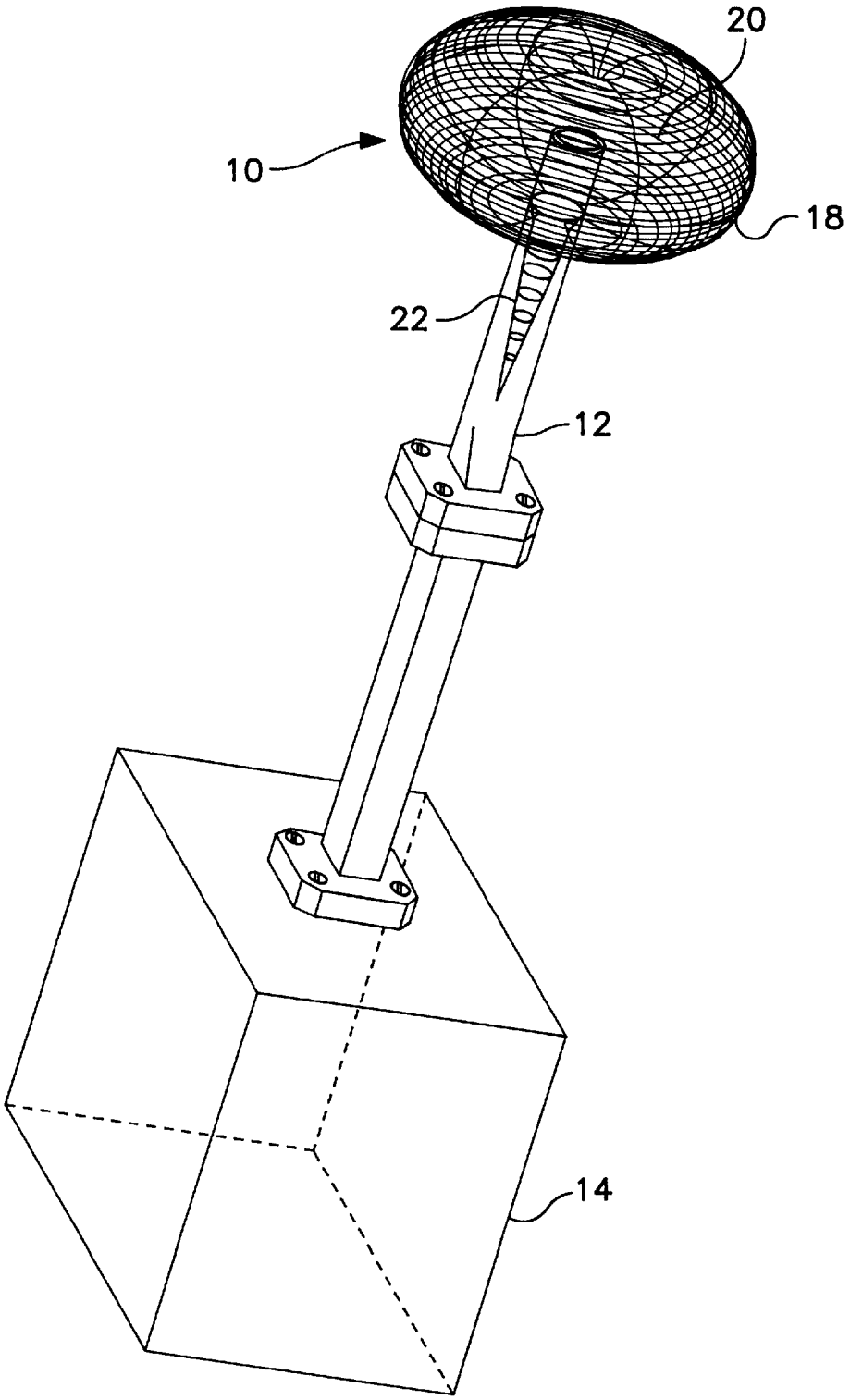
FIG. 1 is a perspective of the omnidirectional isotropic antenna of this invention showing the dielectric lens and the dependent stem inserted into the waveguide.
Figure 2:
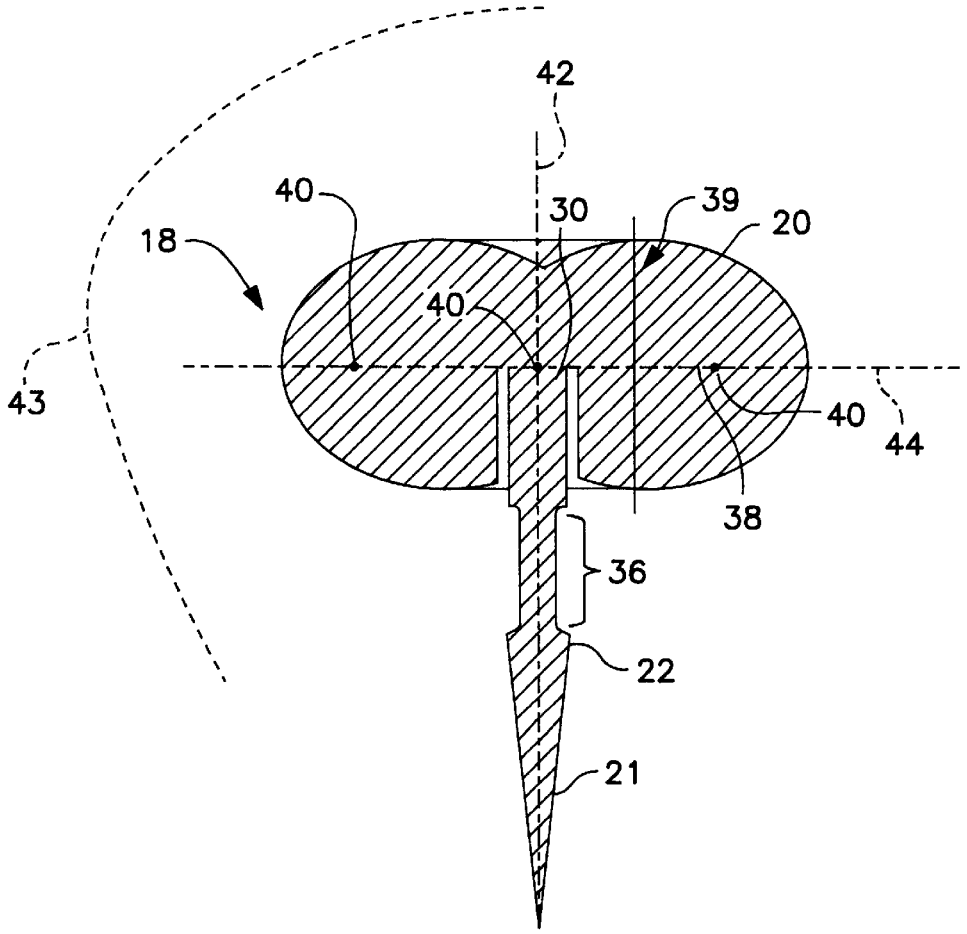
FIG. 2 is a cross-section of the dielectric insert showing the shape of the lens when an ellipse form is rotated about the longitudinal axis of the antenna.
Figure 3:
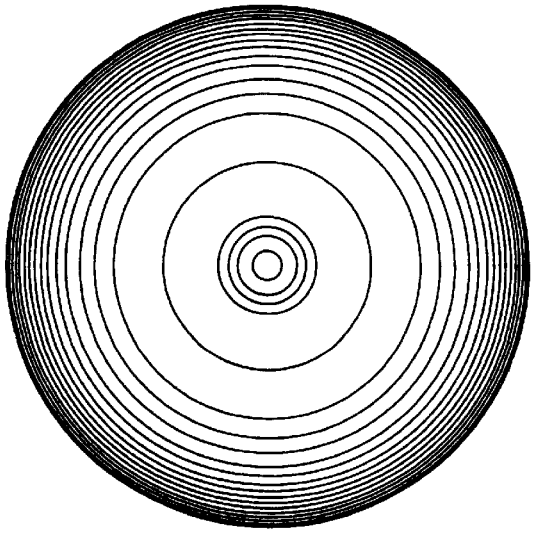
FIG. 3 is a top view of the dielectric insert of FIG. 2.

Referring to FIGS. 1 through 4, there is shown the omnidirectional isotropic antenna identified by the general numeral 10. In the description of the invention whenever the same elements appear in different figures that comprise the omnidirectional antenna, they will bear the same numerical identification. As shown in FIG. 1, the antenna includes a tubular configured waveguide 12, a signal generator and/or receiver 14 which feeds or receives RF signals to and from the dielectric insert identified generally with the numeral 18. As shown in FIG. 2, the dielectric insert 18 is comprised of a lens 20 and a depending stem 22. The top view of the dielectric insert of FIG. 2 is shown in FIG. 3 illustrating the azimuthal symmetry of the elliptoid lens 20.

The contribution of this invention to the art of omnidirectional isotropic antennas resides in the construction of the lens 20. Other contributions to this art include such constructions as the stem integrated with a passband filter which will be discussed in detail hereinafter. Still other features reside in the combination of the stem of the dielectric insert 18 having integrally formed therein a polarizing structure 36 shown in FIG. 2 and an impedance matching configuration 21 which is the tapered end of the stem 22. The construction of the signal generator and transmitter 14 is well-known in the art and need not be further discussed herein.

Figure 4:
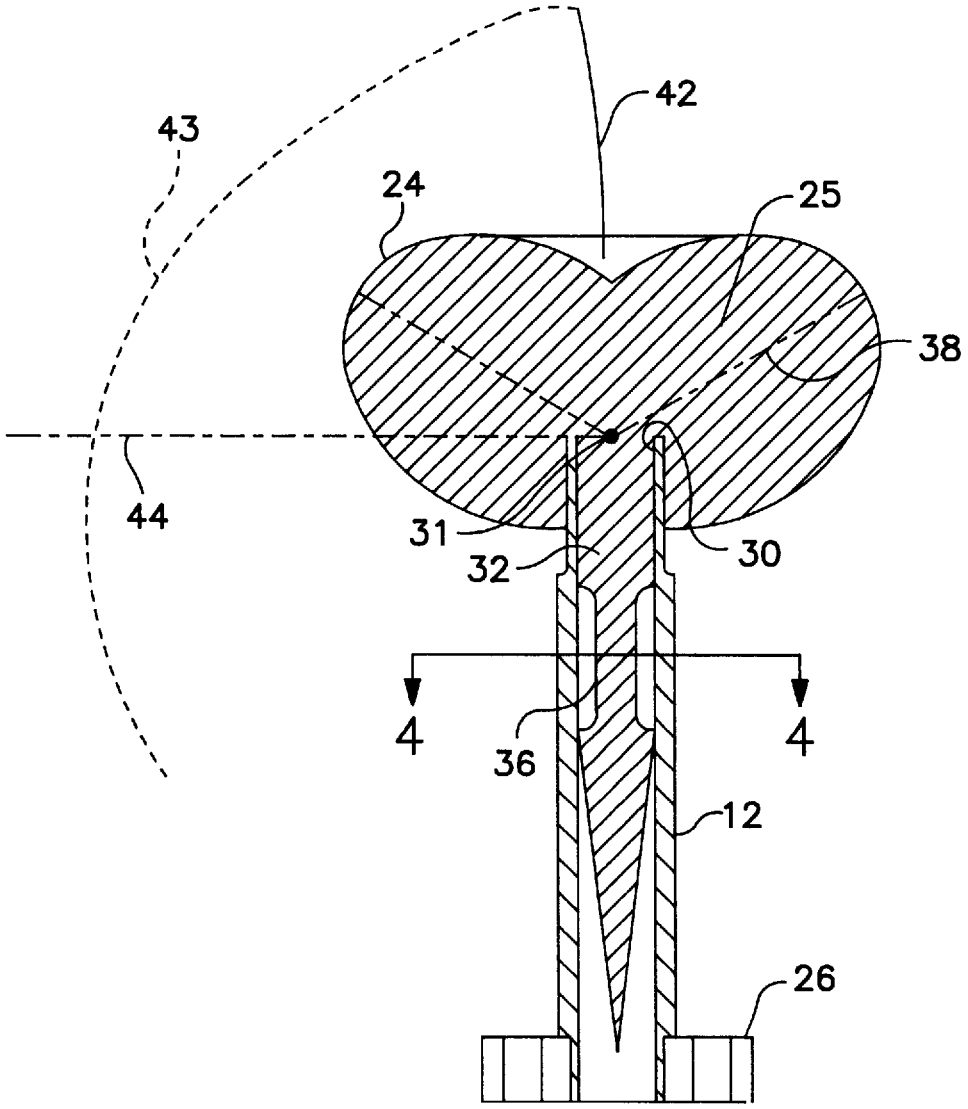
FIG. 4 is a cross-section of the antenna with major axis tilted 30° in zone of rotation of antenna.
Figure 4A:
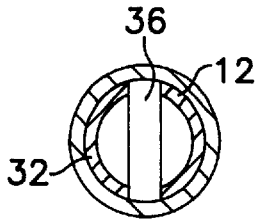
FIG. 4*a* is a cross-section taken along 4—4 of FIG. 4.

The construction of the tubular waveguide 12 is best shown in FIG. 4 which is a cross-section of an omnidirectional isotropic antenna 10 with a dielectric insert 24 which comprises an elliptoid lens 25 and a stem 32, inserted into the upper end of the waveguide 12 at the horn aperture 30. The waveguide is a tubular structure made of a conductive material, such as copper, having one end fixed in a flanged base 26. The foci 31 of the ellipse form that generated the lens 25 is coincident with the horn aperture 30. The stem 32 of the dielectric insert 24 has a polarizing element 36 integrally formed within the stem. The polarizing element 36 responds to the generated RF signal input to the waveguide 12 by polarizing orthogonally the linearly input RF signal by altering the relative rate at which the two orthogonal wave signal components are propagated through the air space around the polarizer 36.

The end of stem 32 is tapered to provide a smooth impedance transformation from the unfilled (no dielectric) waveguide section adjacent to the transmitter/receiver 14 to the completely dielectric filled waveguide adjacent to the lens. The tapered section is easily manufactured by injection molding and therefore provides a low cost but effective impedance match from the transmit/receiver to the lens. Alternate omnidirectional antenna designs such as helices or monopoles require impedance matching circuitry that is much more difficult and expensive to fabricate at millimeter wave frequencies.

The lens is produced by first generating an ellipse with one focus at the horn aperture, and the ellipse major axis 38 at an angle of 0 to 135 degrees with respect to the waveguide axis 42. For example, FIG. 2 depicts an angle of 90 degrees between axes 38 and 42, while FIG. 4 depicts an angle of 60 degrees between these axes. Next the ellipse and waveguide cross-section are rotated 360 degrees about axis 42 to generate a full body of revolution. Defining the angle of rotation about 42 as the "azimuthal" angle, the antenna radiation pattern will have full azimuthal symmetry or is in other words omnidirectional because the antenna itself has azimuthal symmetry.

The length of the ellipse major axis 38 and the angle of the ellipse major axis 38 with respect to the waveguide axis 42, determine the shape of the pattern in the plane formed by axes 42 and 44, referred to as the elevation plane. The eccentricity of the ellipse is equal to one over the square root of the relative dielectric constant of the lens material. The eccentricity determines the ratio of major axes 38 to minor axis 39 and hence the lens shape. The lens will work with any relative dielectric constant, but for the majority of practical materials relative dielectric constants are in the range of 1.0 to 4.0. Hence the practical ratio of major to minor axes is in the range of 1.0:1.0 to 1.0 to 0.25. Other ratios are not necessarily precluded but may not be practical with commonly available low loss dielectric materials.

Figure 8:
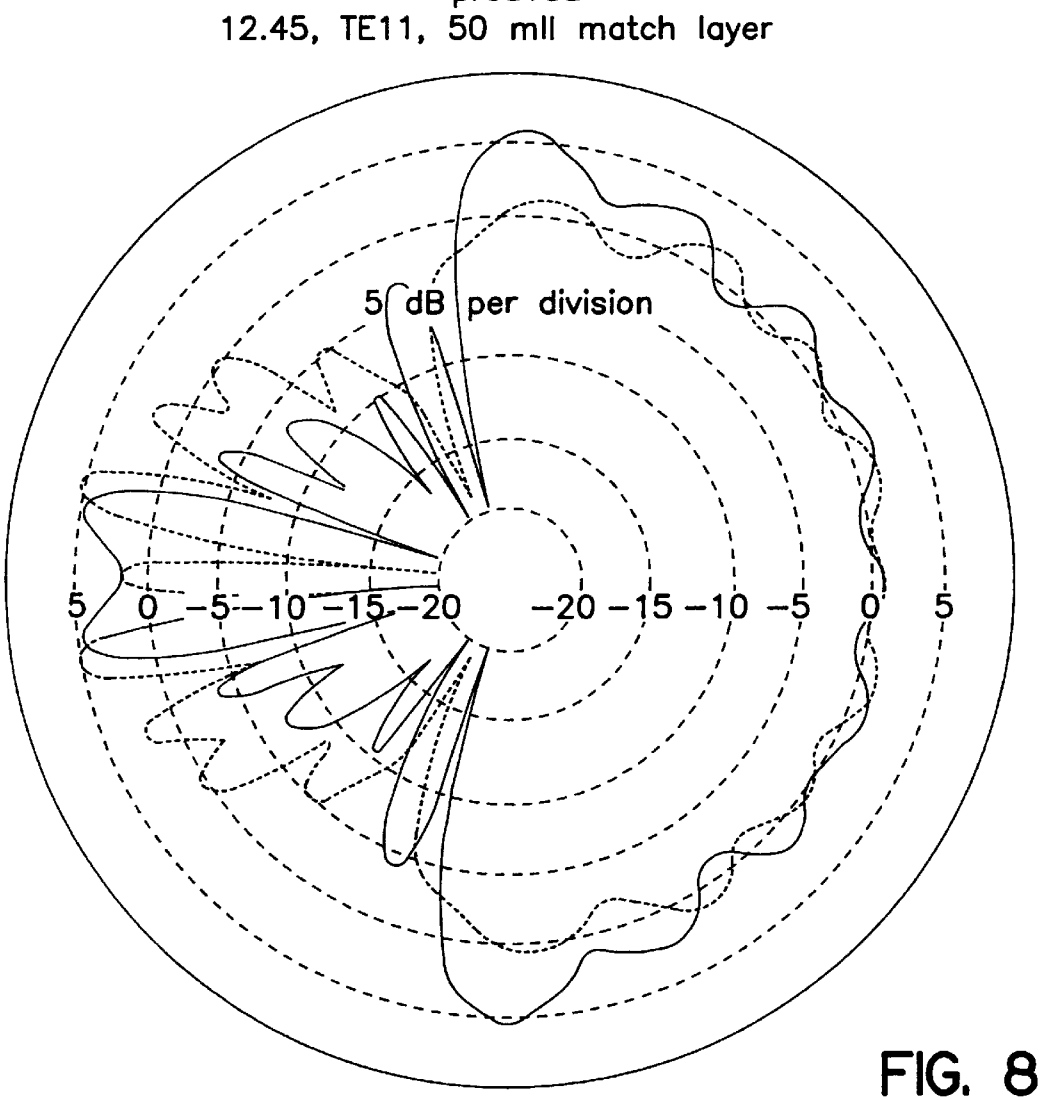
FIG. 8 is a polar radiation plot of the amplitude vs. RF polar angle of the RF signals generated by an antenna identical to the antenna shown in FIG. 2 except the major axis is 8 cm.
Figure 9:
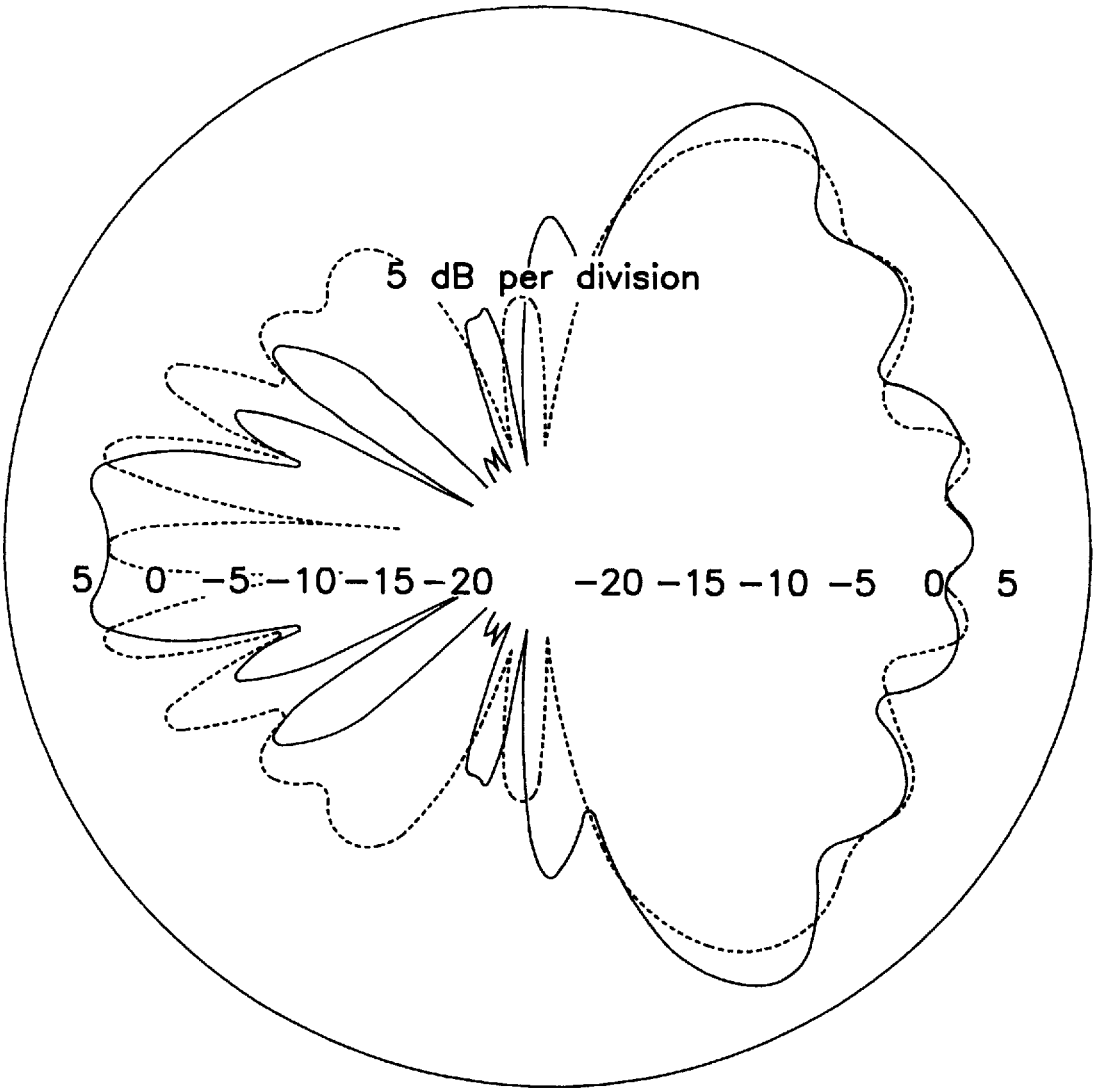
FIG. 9 is a polar radiation plot of the amplitude vs. polar angle of the RF signal pattern generated by the 8 cm major axis positioned at an angle of 30° in the zone of rotation of the antenna as shown in FIG. 4.
Figure 10:
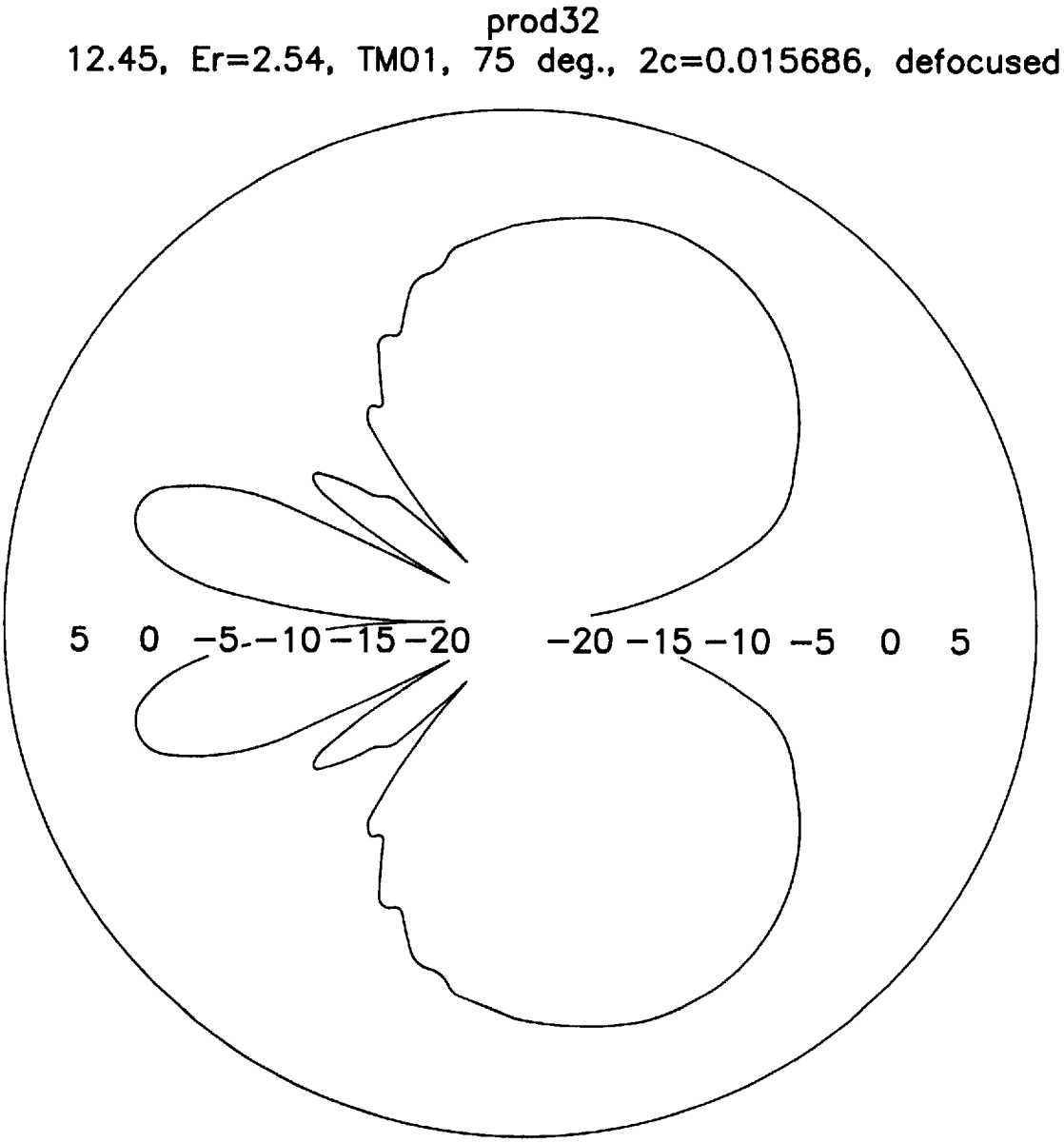
FIG. 10 is a polar radiation plot of the amplitude vs. the RF polar angle generated by the antenna of FIG. 6.

The pattern peak in the elevation plane is determined to a large extent by the angle between the ellipse major axis 44 and the waveguide axis 42. For example, FIG. 2 depicts a lens with an angle of 90 degrees between these axes, and the resultant radiation pattern shown in FIG. 8 has a peak at angle 90 degrees to the waveguide axis 42. An angle of 60 degrees between major axis 38 and waveguide axis 42 as shown in FIG. 4 produces a pattern with peak at angle 60 degrees from the waveguide axis as shown in FIG. 9. The patterns shown in FIGS. 8 and 9 are for the two orthogonal azimuth planes (along 0–180 degrees and 90–270 degrees in azimuth) and emphasize the good azimuthal symmetry produced by this type of antenna.

Figure 7:
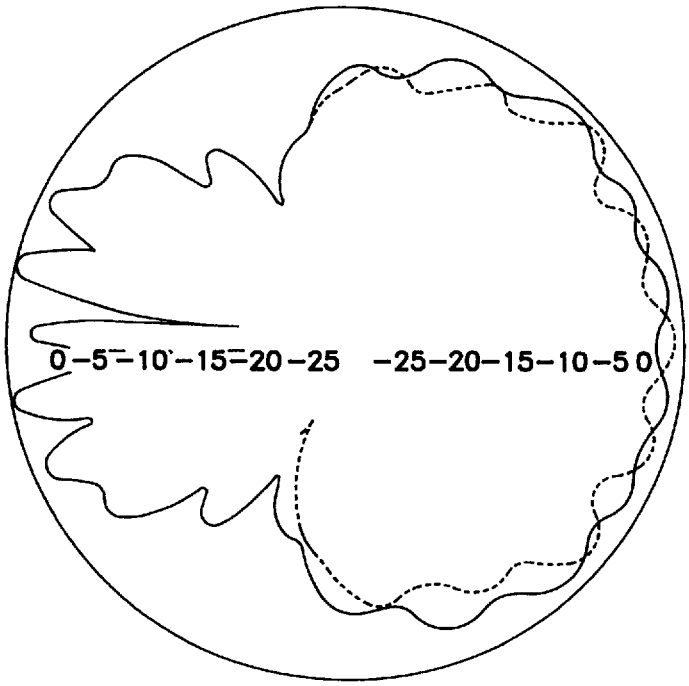
FIG. 7 is a polar radiation plot of the amplitude vs. polar angle of the RF signal pattern generated by the antenna of FIG. 2 which has a 4 cm major axis.

The length of the ellipse major axis 38 determines the relative amount of radiated energy directed along the major axis 38. For example, the pattern shown in FIG. 8 was produced with the antenna shown in FIG. 2 and having a major axis equal to 8 cm and the relative amount of radiation along the major axis direction is clearly pronounced. By decreasing the ellipse major axis to 4 cm relatively less energy is directed along the major axis direction as shown in FIG. 7. The radiation pattern shown in FIG. 7 is approximately isotropic over a hemisphere which is desirable for many ground applications in which the direction of the incident signal is unknown a priori and hence no preferred direction can be anticipated.

Figure 5:
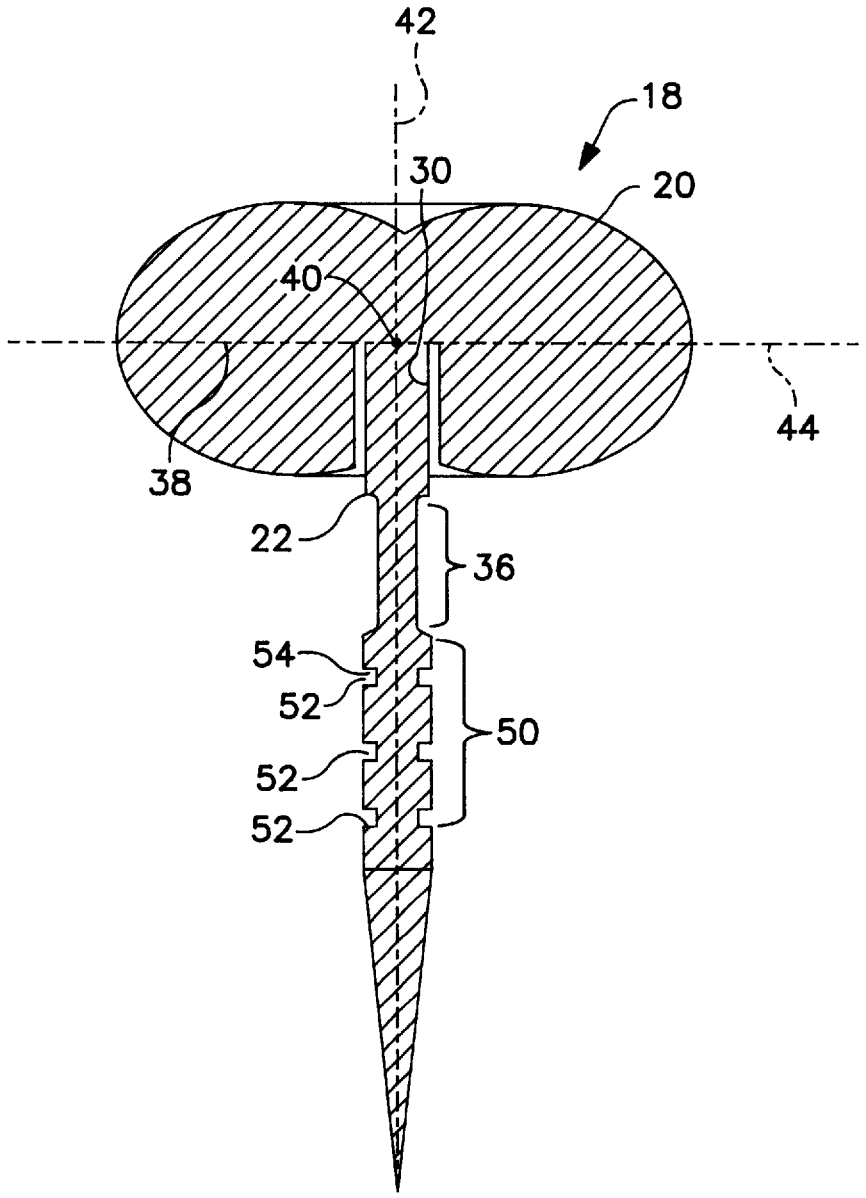
FIG. 5 is a cross-section of a dielectric insert having the configuration of FIG. 2 showing the polarizer, the passband filter structure and the impedance matching portion.

A significant contribution of this invention is the utilization of the dielectric insert structure as a means of integrally forming other controls such as a passband filter into the depending stem. As shown in FIG. 5, the dielectric insert 18 having a lens 20 and a depending stem 22, there is formed integral with the stem 22 the polarizing element 36. Adjacent the polarizing element there is formed a passband filter 50 comprising a series of circumferentially cut grooves 52 axially spaced apart. The periodicity of the grooves 52, the gap width 54 of each groove and the number of such grooves comprising the filter 50 determines the frequency of radiation that will be passed by the filter.

Figure 6:
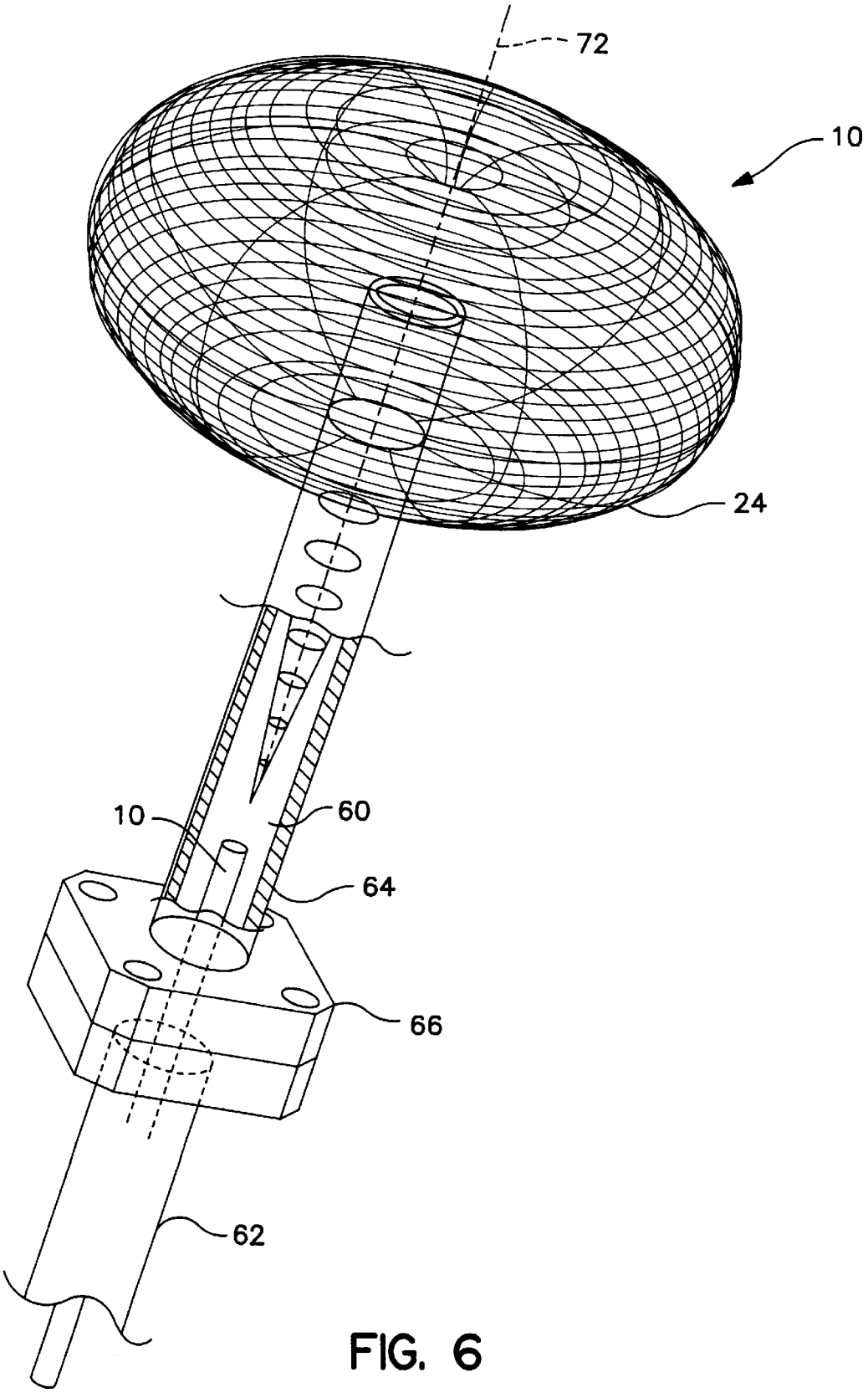
FIG. 6 is a perspective of the omnidirectional isotropic antenna showing the difference mode assembly for controlling the RF pattern transmitted by the dielectric lens.

Referring now to FIG. 6, there is shown the omnidirectional isotropic antenna which is equipped with a modified waveguide 60. Using alternate waveguide modes controls the RF signal patterns that can be transceived. As shown in the perspective of FIG. 6, the waveguide 60 is formed of two tubular sections: a waveguide extension 62 and the primary waveguide 64. The extension waveguide 62 is affixed in spaced apart relation to the primary waveguide 64 being connected through the flanged connector 66. Inserted in the waveguide extension 62 is a coaxial cable 70 which is axially received within the tubular waveguide 62 and it reaches into the primary waveguide 64. The coaxial cable 70 will direct the RF signal into the primary waveguide 64 and thence to the dielectric insert. In terms of performance, the waveguide 60 will excite the higher order TM01 mode whereas the transmitter will excite the waveguide 12 of FIG. 1 with the dominant TE11 sum mode. Electromagnetic wave propagation in waveguides can occur in many possible modes or in combinations of modes. The number of modes that propagate depends on the diameter of the waveguide and the type of excitation. Each waveguide mode possesses a distinct cross sectional field distribution which may result in advantageous performance in specific applications. For example, the TM01 mode produces a cross-sectional field distribution with a null field value along the longitudinal axis of the waveguide 42. The dominant TE11 mode produces a cross sectional field distribution with a peak along the longitudinal axis 42. With the TE11 mode the lens must redirect a substantial amount of energy from the longitudinal axis 42 towards the horizon. In applications where no radiated energy is desired along the longitudinal axis, the TM01 is preferred because the lens does not have to redirect energy along the axis towards the horizon (because there is no energy along the axis).

The response of the lens 24 to the mode difference of FIG. 6 will produce a radiation pattern such as shown in FIG. 8 in which two pronounced side lobes of the signal pattern are traced as generated by the lens 24, and no signal energy is radiated along the longitudinal axis direction 42.

Although the present invention has been described in considerable detail with reference to certain preferred versions thereof, other versions are possible. It is intended to cover all modifications, alternatives and equivalents which may fall within the spirit and scope of the invention as defined in the appended claims.

What is claimed is:

1. An omnidirectional antenna capable of transceiving millimeter and microwave electromagnetic wave radiation patterns comprising:

a tubular configured waveguide comprising a base and a top opening;

a dielectric element for radiating millimeter and microwave electromagnetic waves, said dielectric element comprising:

a lens portion and a stem portion depending from said lens, said stem portion being inserted in said top opening of the waveguide and protruding above said top opening, said lens portion being an elliptoid generated by rotating an ellipse form having a major and minor axis and foci with one of the foci lying in a horizontal plane passing through the top of the waveguide and aligned with the longitudinal axis of the waveguide, the axis of rotation being the major axis of the ellipse which is positioned in a zone defined by the major axis intersecting the horizontal plane 45° below and 75° above the horizontal plane, whereby the elliptoid lens radially distributes the electromagnetic radiation in an omni direction.

2. The antenna as claimed in claim 1 wherein the ratio of the length of the minor axis to the major axis is in the range of 1:1.0 to 1.0:0.25.

3. The antenna as claimed in claim 1 wherein the elliptoid is generated by rotating an ellipse form wherein the ratio of minor axis to major axis 1:0.47.

4. The antenna as claimed in claim 1 wherein the elliptoid is generated by rotating an ellipse having a minor axis that is 1.018 cm. and a major axis of 2.134 cm.

5. The antenna as claimed in claim 1 wherein the lens has a dielectric constant in the range of 1.0 to 4.0.

6. The antenna as claimed in claim 1 wherein the antenna is impedance matched to the waveguide by tapering the stem of the dielectric element.

7. The antenna as claimed in claim 1 wherein the top open end of the waveguide is the horn aperture.

8. The antenna as claimed in claim 1 wherein the frequency of the RF signals is in the range of 1 GHz to 400 GHz.

9. An omnidirectional antenna capable of transceiving millimeter electromagnetic wave radiation patterns comprising:

a tubular configured waveguide comprising a base and a top opening;

a dielectric element for radiating millimeter and microwave electromagnetic waves said dielectric elements comprising:

a lens portion and a stem portion depending from said lens, said stem portion being inserted in said top opening of the waveguide and the lens portion protruding above said top opening, said lens portion being an elliptoid generated by rotating an ellipse form having a major and minor axis and foci with one of the foci lying in a horizontal plane passing through the top of the waveguide and aligned with the longitudinal axis of the waveguide, the axis of rotation being the major axis which is positioned in a zone with the major axis intersecting the horizontal plane 45° below and 75° above the horizontal plane, and wherein the ratio of the length of the minor axis to the major axis is in the range of 1:1.0 to 1:0.25, whereby the elliptoid lens radially distributes the millimeter and microwave electromagnetic radiation in an omni direction.

10. An omnidirectional antenna capable of transceiving millimeter electromagnetic wave radiation patterns comprising:

a tubular configured waveguide comprising a base and a top opening;

a dielectric element for radiating millimeter electromagnetic waves said dielectric elements comprising:

a lens portion and a stem portion depending from said lens, said stem portion being inserted in said top opening of the waveguide and the lens portion protruding above said top opening, said lens portion being an elliptoid generated by rotating an ellipse form having a major and minor axis and foci with one of the foci lying in a horizontal plane passing through the top of the waveguide and aligned with the longitudinal axis of the waveguide, the axis of rotation being the major axis which is positioned in a zone with the major axis intersecting the horizontal plane 45° below and 75° above the horizontal plane, said stem portion being configure circularly to polarize the transceived RF signal whereby the elliptoid lens radially distributes the millimeter electromagnetic radiation in an omni direction.

11. An omnidirectional antenna capable of transceiving millimeter electromagnetic wave radiation patterns of a predetermined frequency comprising:

a tubular configured waveguide comprising a base and a top opening;

a dielectric element for radiating millimeter electromagnetic waves said dielectric elements comprising:

a dielectric lens portion and a stem portion depending from said lens, said lens portion having an elliptoid shape, a passband filter formed in the stem portion comprising a series of circumferential grooves extending axially in spaced apart relation along the stem portion, the inner surface of said grooves being coated with a conductive film;

whereby the antenna is adapted to pass RF signals of a predetermined frequency.

12. The antenna as claimed in claim 11 wherein the passband will pass RF signals in the range of 40–44 GHz.

13. The antenna as claimed in claim 11 wherein the elliptoid shape is generated by rotating an ellipse form having a major and minor axis and foci with one of the foci lying in a horizontal plane passing through the top of the waveguide and aligned with the longitudinal axis of the waveguide, the axis of rotation being the major axis which is positioned in a zone with the major axis intersecting the horizontal plane below and 75° above the horizontal plane.

14. The antenna as claimed in claim 11 wherein the dielectric lens portion has a dielectric constant in the range of 1.0 to 4.0.

15. The antenna as claimed in claim 14 wherein the lens portion is made of polystyrene.

16. An omnidirectional antenna capable of transceiving millimeter electromagnetic wave radiation patterns that are flared out relative to the axis of symmetry of the polar radiation pattern comprising;

a tubular configured waveguide comprising a base and a top opening;

a dielectric element for radiating millimeter electromagnetic waves said dielectric elements comprising:

a lens portion and a stem portion depending from said lens, said stem portion being inserted in said top opening of the waveguide and the lens portion protruding above said top opening, said lens portion having an elliptoid shape; said tubular configured waveguide comprising a primary waveguide section and an extension waveguide section, the extension waveguide section being coaxially aligned with the primary waveguide section and including a coaxial cable proximate the primary waveguide section for directing RF signals into the primary waveguide section, wherein the omnidirectional generated by the lens tends to flare out relative to the axis of symmetry.

* * * * *